United States Patent [19]

Lemay

[11] 4,050,260

[45] Sept. 27, 1977

[54] UNDERGROUND CABLE LAYING MACHINE

[76] Inventor: Denis Lemay, R. R. No. 1, Bromptonville, Canada

[21] Appl. No.: 702,478

[22] Filed: July 6, 1976

[51] Int. Cl.[2] ..... A01B 3/64; A01B 11/00; F16L 1/00

[52] U.S. Cl. ..... 61/72.6; 37/DIG. 18; 172/40; 61/72.4

[58] Field of Search ..... 61/72.4, 72.6, 105; 37/88, 193, DIG. 18; 172/40, 698

[56] References Cited

U.S. PATENT DOCUMENTS

| | | | |
|---|---|---|---|
| 3,326,010 | 6/1967 | Gagne | 61/72.6 |
| 3,508,616 | 4/1970 | Hubbard | 172/40 |
| 3,514,960 | 6/1970 | Howard | 172/40 X |
| 3,575,006 | 4/1971 | Rugroden | 61/72.6 |
| 3,633,683 | 1/1972 | Shatto | 172/40 X |
| 3,713,300 | 1/1973 | Ward | 172/40 X |

FOREIGN PATENT DOCUMENTS

| | | | |
|---|---|---|---|
| 727,746 | 10/1942 | Germany | 61/72.4 |
| 1,171,830 | 6/1964 | Germany | 61/72.6 |
| 1,189,602 | 3/1965 | Germany | 172/40 |

*Primary Examiner*—Dennis L. Taylor

[57] ABSTRACT

A machine adapted to lay a utility cable underground and characterized by leaving no substantial and lasting scar at the surface of the ground, by laying the cable at a uniform depth, by being usable even over the softest ground without leaving any lasting imprint, and by using a reciprocative cutting action avoiding impact vibrations and the annoyance thereof. This machine comprises a body mounted on runners, a cutter in the form of a lever pivoted to the body about a transverse axis and having a cutting edge extending endwise from the body below the runners, a camshaft and motor actuating the cutter, a cable guide guiding the cable downwardly coextensive with the cutting edge, ground-engaging wheels, and a handle carrying the wheels and articulated to select one of three distinct elevation of the wheels relative to the body of the machine.

5 Claims, 4 Drawing Figures

UNDERGROUND CABLE LAYING MACHINE

This invention relates to a machine of the type adapted to lay a cable, such as an electric or telephone utility cable, at a limited depth in the ground.

It is now common practice to lay in the ground the utility cables, such as for the electricity and telephone. Up to now, this has been currently done by digging the ground to the desired depth, very often by hand shovel. This is not very efficient and, in any way, is not well accepted by private property owners due to the scars left by the digging such as on lawns.

It is a general object of the present invention to provide an underground cable laying machine of the above type which produces underground laying of a cable while avoiding any substantial digging scar.

It is another object of the present invention to provide an underground cable laying machine of the above type which efficiently and reliably lays a cable at a uniform depth, which may be used even over the softest ground without leaving any lasting imprint, and which produces a reciprocative cutting action while avoiding impact vibrations and the annoyances thereof.

The above and other objects and advantages of the present invention will be better understood with reference to the following detailed description of a preferred embodiment thereof which is illustrated, by way of example, in the accompanying drawings, in which.

Figure 1:
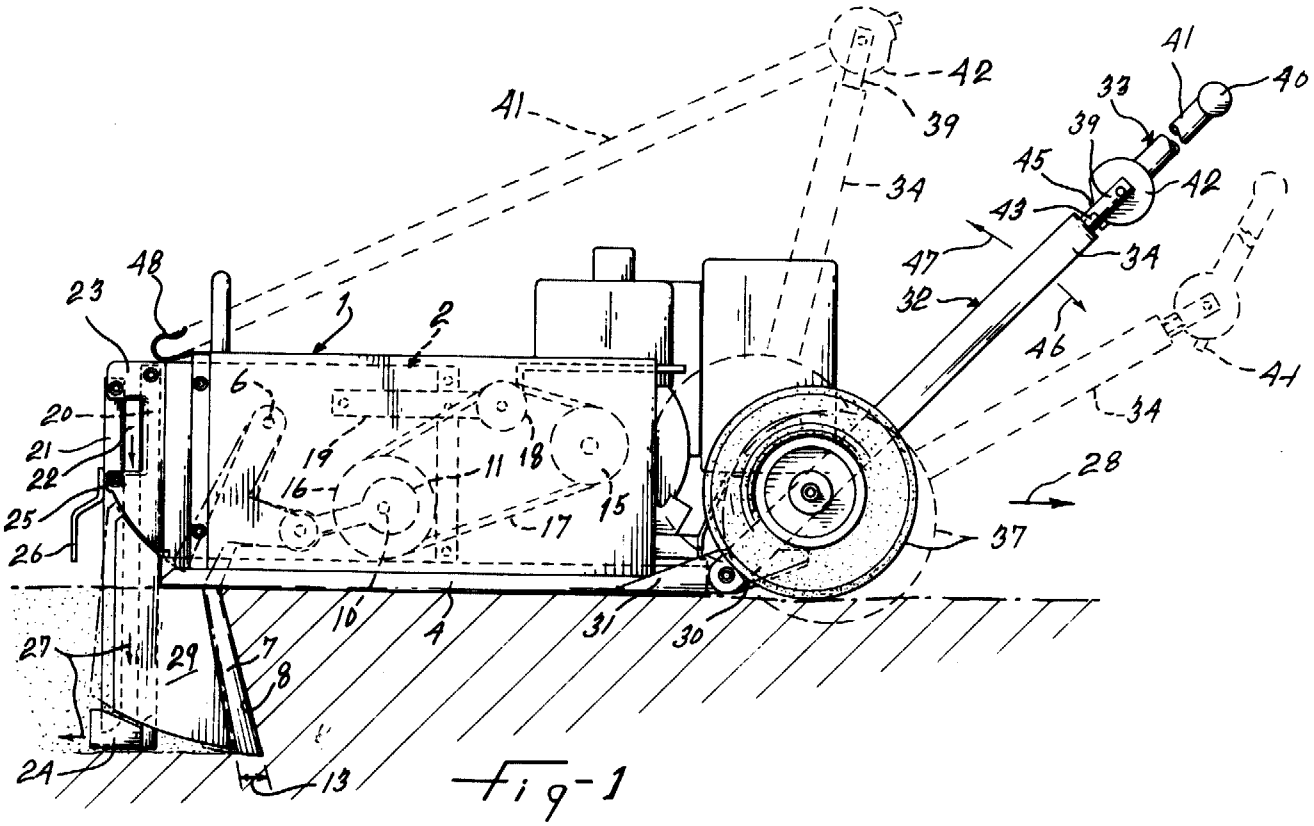
FIG. 1 is a side elevation view of an underground cable laying machine according to the present invention.
Figures 2, 3, 4:
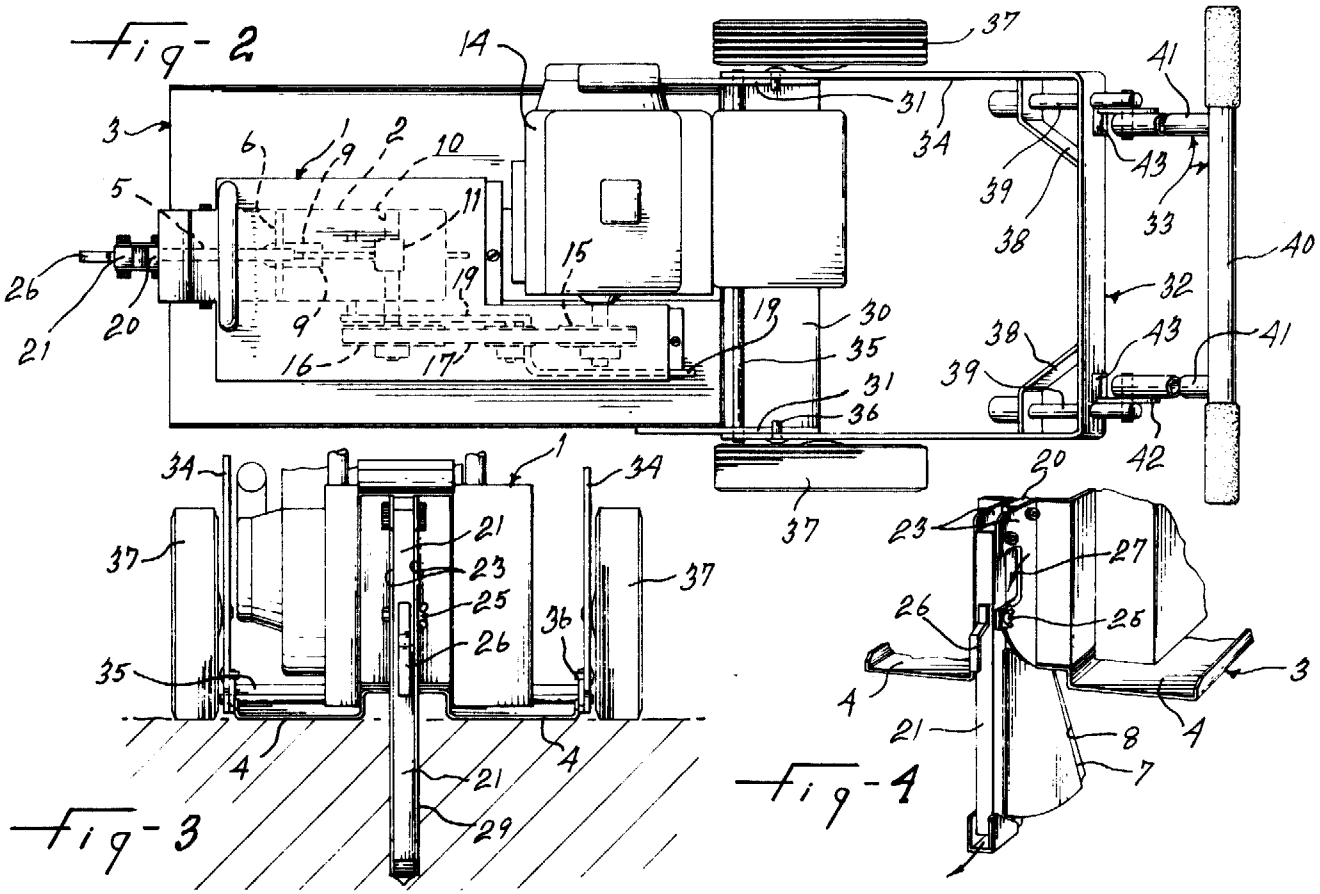
FIG. 2 is a top view of the machine of FIG. 1.
FIG. 3 is a rear end view of the machine.
FIG. 4 is a perspective view of and part of the cutter and the associated cable guide.

The illustrated cable laying machine comprises a body including an external casing 1 formed of sheet metal parts firmly fixed together by bolts or screws. The body of the machine also includes an intermediate sheet metal enclosure 2 in the outer casing 1. Each of the casing 1 and internal enclosure 2 is formed with parallel sheet metal sides forming a support for the components therein. A sheet metal plate 3 is fixedly secured to the casing 1 and enclosure 2 to support the body defined by them. The sheet metal plate 3 is transversely profiled or shaped to form a pair of runners 4 extending lengthwise in the longitudinal direction of the body.

An elongated cutter 5 is pivoted at its upper end in the internal enclosure 2 by a pin 6 defining a transverse pivot axis relative to the body of the machine. The elongated cutter 5 includes a lower end portion 7 downwardly projecting from the body of the machine and having a forwardly facing cutting edge at 8. The cutting edge downwardly extends endwise below the ground support defined by the runners 4.

The elongated cutter 5 includes a pair of forwardly projecting lugs 9 laterally spaced apart from each other transversely of the machine. A reciprocating drive assembly is connected to the cutter 5 and includes a cam shaft 10 carrying a cam 11 and rotatably carried by the internal enclosure 2. The cam shaft 10 defines a transverse rotation axis extending parallel to the pivot axis of the elongated cutter 5. A connecting rod 12 operatively connects the cam 11 to the lugs 9, whereby the rotation of the cam produces to and fro reciprocation of the cutter 5 in the longitudinal direction of the body of the machine. This to and fro reciprocation results in a short stroke of the cutting edge in the longitudinal direction of the machine, as indicated by the arrow 13, in FIG. 1.

The reciprocation drive assembly also includes an internal combustion engine 14 fixed on the baseplate 3 externally of the outer casing 1 and having a driving pulley 15 fixedly secured on the output shaft thereof inside the outer casing. A second pulley 16 is fixedly secured on the camshaft 10 inside the outer casing 1 and a belt 17 drivingly connects the two pulleys 15 and 16 and an idler pulley 18. The latter is mounted on a belt tensioning arm 19 which is pivoted inside the outer casing 1 and externally reachable to set the tension in the belt.

A cable guide is provided rearward of the elongated cutter 5 and includes a forward and a rearward cable guide bars 20 and 21 which longitudinally extend upright and are spaced to form a cable guide channel 22 between them. The internal enclosure 2 defines a pair of rearward outer projections 23 laterally spaced apart from each other transversely of the machine and traddling the upper portion of the cable guide bars 20 and 21. The cable guide bars 20 and 21 downwardly extend endwise substantially coextensive with the cutting edge or lower end of the cutter 5. A cable guide trough 24 is fixed to the lower end of the forward cable guide bar 20 and projects rearwardly therefrom in alignment with the lower end of the cutter in the afore-mentioned longitudinal direction. The rearward cable guide bar 21 is pivoted at its upper end; is releasably fixed by a wing nut 25 and is provided with a handle 26 to be upwardly pivoted and thus give access into the upright cable guide channel 22. The arrows 27 indicate the path followed by the utility cable down into the cable guide channel and rearwardly out of the latter as the machine is operatively advanced in the direction of the arrow 28. The cable guide is particularly characterized by a pair of cable guide wings or plates 29 which are fixedly secured against the opposite sides of the cutter 5; downwardly extend edgewise coextensive with the cutting edge 8 and are laterally spaced apart to straddle the guide bars 20 and 21. Thus, the cable guide ensures that the cable is released at uniform depth rearward of the lower end of the cutter 5, before the soil or ground drops back and closes the cut formed by the cutter.

An inclined plate or panel 30 is fixed to the front end of the baseplate 3 and forms the upwardly inclined front portion of the upwardly inclined front portion of the runners 4. The panel 30 has upwardly projecting opposite lateral edges 31. A handle is pivotally connected to the front panel 30 and includes a lower section 32 and an upper section 33. The lower handle section 32 includes a U-shape metal body 34 having the opposite free legs pivoted to the edge 31 by a rod 35. The latter extends transversely of the machine and defines a first handle pivot axis. A pair of studs 36 are fixed to the legs of the U-shape metal body 34 to form abutments for the lower handle section 32 against the metal plate 30. Thus, these studs 36 limit the downward pivoting of the lower handle section relative to the runners 4 and the body of the machine. A pair of ground-engaging wheels 37 are rotatably mounted on the opposite legs of the member 34 and cooperatively define a wheel rotation axis extending transversely of the machine. Thus, the wheels 37 pivot with the lower handle section relative to the body of the machine.

A bracket 38 is fixed in each corner of the U-shape metal body 34 to strengthen the corresponding corner and cooperatively carry a spring-biased plunger 39. Each plunger 39 has a free end outwardly projecting away from the main portion of machine while the plunger, as a whole, is inwardly biased toward a contracted position. The upper handle section 33 also has a U-shape outline defined by an intermediate handle bar 40 and a pair of lateral tubular legs 41. Each leg 41 has a cam-like abutment device rigidly secured thereto at the outer end thereof. Each leg 41 is also pivotally connected to the corresponding plunger 39 about a second handle pivot axis. The intermediate portion of the U-shape body 34 is provided with a pair of projections or stops 43 outwardly projecting in registry with the cam-like abutment devices 42. Each cam-like abutment device 42 is formed with a first angular abutment 44 and a second abutment 45.

When the handle sections 32 and 33 are aligned, as shown by the full line position in FIG. 1, the wheels 37 are barely touching the ground and the machine is supported by the runners 4; this corresponds to the operative position of the machine. The mere to and fro reciprocation of the cutter 5 then cuts a narrow slit or cut which closes by itself over the laid cable.

When the upper handle section 33 is pulled forward against the bias on the plungers 39, this handle section may be pivoted for abutment of the stops 43 against the abutment 45; that is, in the direction of the arrow 46. This lowers the wheels 37 relative to the body of the machine and allows to lift the cutter 5 off the ground and thus roll the machine to another spot.

When the upper handle section 33 is upwardly pivoted in the direction of the arrow 47, the handle bar 40 may be rested in a spring clip 48 on the rear of the machine; the latter is thus in a transport or storage position with the wheels 37 well off the ground.

It must be noted that with either abutments 44 or 45 in engagement with the stops 43, the handle will react bodily to any downward pressure or force on the handle bar 40.

What I claim is:

1. An underground cable laying machine comprising a body operatively defining a forward longitudinal direction, runners fixed under said body, extending lengthwise in said longitudinal direction and operatively supporting the whole cable laying machine on the ground, a cutter having an elongated cutting edge downwardly extending endwise below the runners, a cable guide including a pair of cable guide wings downwardly extending edgewise substantially co-extensive with said forward longitudinal direction and laterally guiding a cable in downwardly extending position rearward of said cutting edge, pivot means pivotally supporting said cutter on said body for pivotal movement of the cutter about a transverse axis relative to said body and to said longitudinal direction, reciprocation drive assembly mounted on said body, connected to said pivoted cutter, and reciprocatively pivoting the latter to and fro in said longitudinal direction, an elongated handle including a lower section and an upper section, ground-engaging wheels rotatably connected to said lower section and defining a wheel rotation axis extending transversely of said body, said lower section being pivoted to the assembly of said runners and body about a second pivot axis extending transversely of said runners and body at the opposite end of the latter relative to said cutter, a first abutment means operatively interposed between said lower section and said runners and limiting downward pivoting of said lower section relative to said runners and body, said upper section being pivoted to the upper end of said lower section about a third pivot axis extending transversely of said runners and body, and a second abutment means operatively interposed between said lower section and upper section and adjustably limiting the downward pivoting of said upper section relative to said lower section about said third pivot axis.

2. An underground cable laying machine as defined in claim 1, wherein said cable guide includes cable guide bars secured to said body and downwardly extending endwise substantially coextensive with the cutting edge, said cable guide wings are fixed to said cutter, laterally straddle the cable guide bars, and cooperatively form an upright cable guide channel with the cable guide bars, the latter includes a forward cable guide bar rigidly fixed to said body and downwardly projecting endwise below the latter, a cable outlet guide trough is fixed to the lower end of the forward cable guide bar and rearwardly projects therefrom in substantial alignment with the lower end of the cutting edge in said longitudinal direction, said cable guide bars includes a rearward cable guide bar pivoted to said body about a transverse axis and pivotally giving access into said upright cable guide channel, said reciprocation drive assembly includes a camshaft, a motor operatively rotating said camshaft, and a connecting rod connected between the camshaft and the pivoted cutter and pivotally reciprocating the latter in response to rotation of the camshaft.

3. An underground cable laying machine comprising a body adapted to be progressed over the ground in a forward direction, a cutter extending downwardly below said machine and adapted to be inserted within the ground, pivot means pivotally supporting the upper portion of said cutter to said body for pivotal movement of the cutter relative to said body in the plane of progression of said machine over the ground, said cutter having an elongated cutting edge at its front side, reciprocation drive assembly mounted on said body connected to said pivoted cutter and reciprocatively pivoting the latter to and fro in said longitudinal direction, guide wings secured to said cutter downwardly extending edgewise substantially co-extensive with said cutter and protruding rearwardly of the latter and elongated cable guide members secured to said body and downwardly extending endwise substantially co-extensive with the cutter and behind the latter and between said guide wings, said cable guide members forming a substantially vertically extending cable guiding channel which is independent of the reciprocating pivoting movement of said cutter, said guide channel having a cable inlet at its upper end and a cable outlet at its lower end, said cable outlet being substantially positioned at the level of the lower end of said cutter.

4. An underground cable laying machine as claimed in claim 3, wherein said cable guide members include a forward cable guide bar rigidly fixed to said body and a rearward guide bar secured to said body, said cable outlet including a cable outlet guide trough fixed to the lower end of the forward cable guide bar and rearwardly projecting therefrom in substantial horizontal alignment with the lower end of the cutter, rearwardly of the same, and said cable guide wings laterally straddling the elongated cable guide members and co-operatively forming said upright cable guide channel therewith in the region above said cable outlet guide trough.

5. An underground cable laying machine as claimed in claim 4, wherein said rearward cable guide bar is pivotally connected to said body at its upper end about a transverse axis for rearward pivotal movement clearing said wings, said trough and said cable inlet to give access into said upright cable guide channel and means to removably secure said rearward cable guide bar in substantially vertical position closing access to said guide channel.

* * * * *